US006099422A

United States Patent [19]

Rappaport et al.

[11] Patent Number: 6,099,422

[45] Date of Patent: Aug. 8, 2000

[54] PRESSURIZED BAT

[75] Inventors: Mark J. Rappaport, Rancho Santa Fe; Thomas H. Grimm, St. Helena; Terry J. Sanchez, Half Moon Bay, all of Calif.

[73] Assignee: OddzOn, Inc., Napa, Calif.

[21] Appl. No.: 09/096,275

[22] Filed: Jun. 11, 1998

[51] Int. Cl.[7] ..... A63B 59/06

[52] U.S. Cl. ..... 473/567

[58] Field of Search ..... 473/564, 566, 473/568

[56] References Cited

U.S. PATENT DOCUMENTS 4,917,382 4/1990 Hendershott .
5,150,897 9/1992 Wortman .
5,827,142 10/1998 Rappaport ..... 473/567

FOREIGN PATENT DOCUMENTS 37126 3/1977 Japan .
2146538 4/1985 United Kingdom .

OTHER PUBLICATIONS

Copy of 1996 OddzOn® products brochure depicting pressurized bat (2 sheets).

*Primary Examiner*—Mark S. Graham
*Attorney, Agent, or Firm*—Kolisch Hartwell Dickinson McCormack & Heuser

[57] ABSTRACT

A lightweight bat with a pressurized striking portion and a separate handle portion.

12 Claims, 2 Drawing Sheets

PRESSURIZED BAT

The present invention relates to bats and more particularly to a lightweight bat with a striking portion including a pressurized chamber.

BACKGROUND OF THE INVENTION

Baseball in its many variations is a pastime enjoyed by many people. Depending on the age and preference of the player, the bat used in baseball and related sports may be a heavy wood or aluminum model, as used by adolescents and adults in baseball, or a light plastic-type, as may be used by children to hit a wiffle ball. One disadvantage of existing lighter, plastic bats is that they have little elastic rebound and therefore do not drive the ball very far. The heavier wood or aluminum bats have good rebound, but are unsuitable for use by small children due to the hardness and weight of the bat.

In response to the deficiencies with existing light plastic bats, two types of pressurized plastic bats have been developed. In the simpler of these two types, a bat-shaped container is formed from polycarbonate and charged with air. This single-chamber pressurized bat provides a good rebound while retaining the light weight of other plastic bats. The second type of pressurized plastic bat that has been developed, and is disclosed in U.S. Pat. No. 5,827,142 to Rappaport, which is incorporated herein by reference, uses two pieces: an unpressurized handle and a pressurized striking portion. The pressurized striking portion is similar to a two-liter soda bottle, but includes a neck which is adapted to join to the handle.

SUMMARY OF THE INVENTION

The present invention is a lightweight bat with a pressurized striking portion and a separate handle portion. In some embodiments of the present invention a coupler is provided to interconnect the striking portion and the handle portion. The handle portion may include a socket with internal threads and the coupler may include external threads which allow the coupler to be screwed into the handle portion. The striking portion may include a bottle and a closure structure adapted to seal an opening at a handle end of the bottle. The bottle may have a radial local extremum disposed away from the opening to facilitate gripping of the bottle by the coupler.

DETAILED DESCRIPTION

Figure 1:
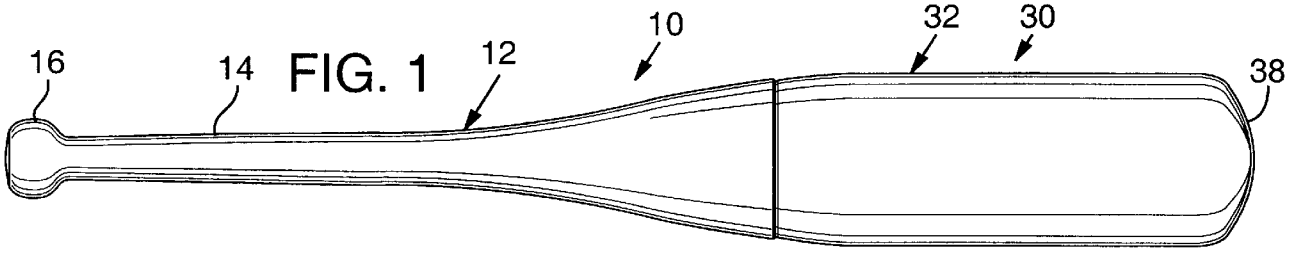
FIG. 1 is an elevational view of a bat constructed according to the present invention.

A bat constructed according to the present invention is shown generally at 10 in FIG. 1. Bat 10 includes a hollow, tubular handle portion 12 having a gripping region 14 with a knob 16 at one end. An end cap 18 is fitted into the open end of knob 16 to close the end of the handle. Opposite knob 16, handle portion 12 tapers outward from gripping region 14 to a socket 20. The socket has an internal thread 22 and an open end 24. A elastomeric or foam gasket 26 is mounted to the open end of the socket. A locking hole 28 extends through the handle portion adjacent the internal thread. The handle portion is preferably injection molded from polyethylene (PE) structural foam to allow relatively thick sections while maintaining a light weight.

Figure 2:
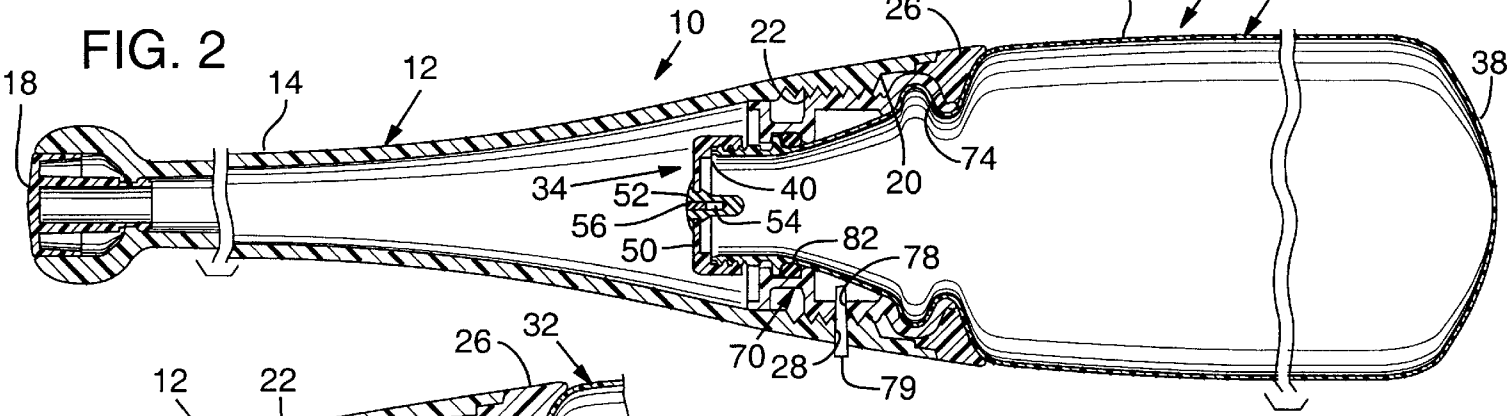
FIG. 2 is a cross-sectional view through the bat of FIG. 1.

Socket 20 is adapted to receive a pressurized striking portion 30. Striking portion 30 includes a pressure vessel in the form of a polyethylene terephthalate bottle 32, stretch blow-molded or two-phase blow-molded, and a closure structure 34 for the bottle. Bottle 32 is similar to a two-liter soda bottle and has a generally cylindrical body portion 36, a closed end 38 and an open end 40. Moving to the right from the open end in FIG. 2, the bottle includes a threaded region 42 extending to a polygonal collar 43. A neck region 44 flares out from the collar 43 to a raised shoulder 46 followed by a radial constriction or waist portion 48 of the bottle which extends to the body portion. The raised shoulder and constriction can also be viewed as a radial ripple in the surface of the bottle, i.e., where the radius of the bottle has a local minima, a point of inflection and a local maxima. This ripple allows the bottle to be gripped securely against axial movement, as will be described below. More generally, a local extremum, either minimum or maximum, can be used to mechanically lock or stabilize the bat against axial excursions.

Closure structure 34 includes a cap 50 which screws onto threaded region 42. A rubber bung 52 is disposed through a hole formed in the top of the cap. With the cap in place on the bottle, the bottle is charged by inserting a needle through the bung and injecting air to between 10 and 50 and more preferably to 25–35 psi. The pressure can be adjusted to increase the rebound when a ball is hit. Bung 52 includes an orifice 54 that extends through the cap so that, after the bottle is charged and the needle is withdrawn, a retainer 56 can be installed to prevent the bung from being removed from the cap.

Figure 3:
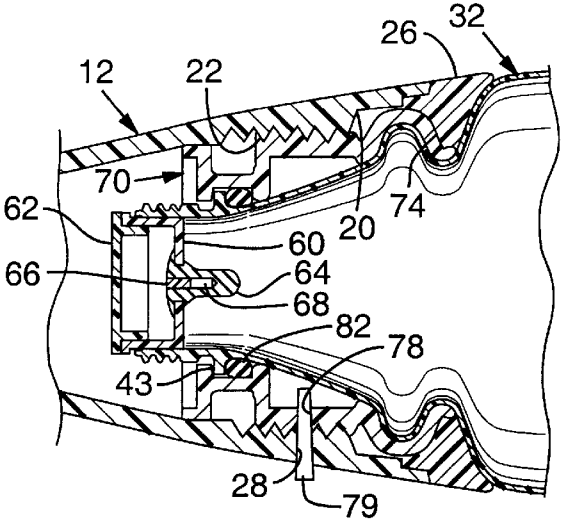
FIG. 3 is a cross-sectional view through an alternative closure structure for use in the bat of FIG. 1.

An alternative closure structure in the form of a plug 60 and cap 62 is shown in FIG. 3. Plug 60 is sized to fit within the open end and is sonic welded into place. A bung 64 is installed through a hole in the plug and the bottle is charged, just as previously described. A retainer 66 is fit into an orifice 68 in the bung to prevent displacement of the bung. Cap 62 is sonically welded over the plug after charging to prevent inadvertent damage to or removal of the bung.

Figure 4:
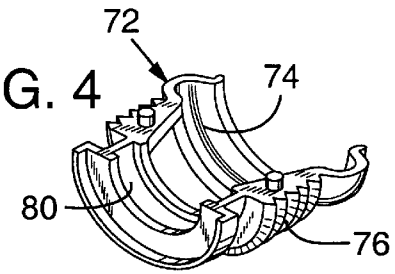
FIG. 4 is a perspective view of a coupler half for use in the bat of FIG. 1.
Figure 5:
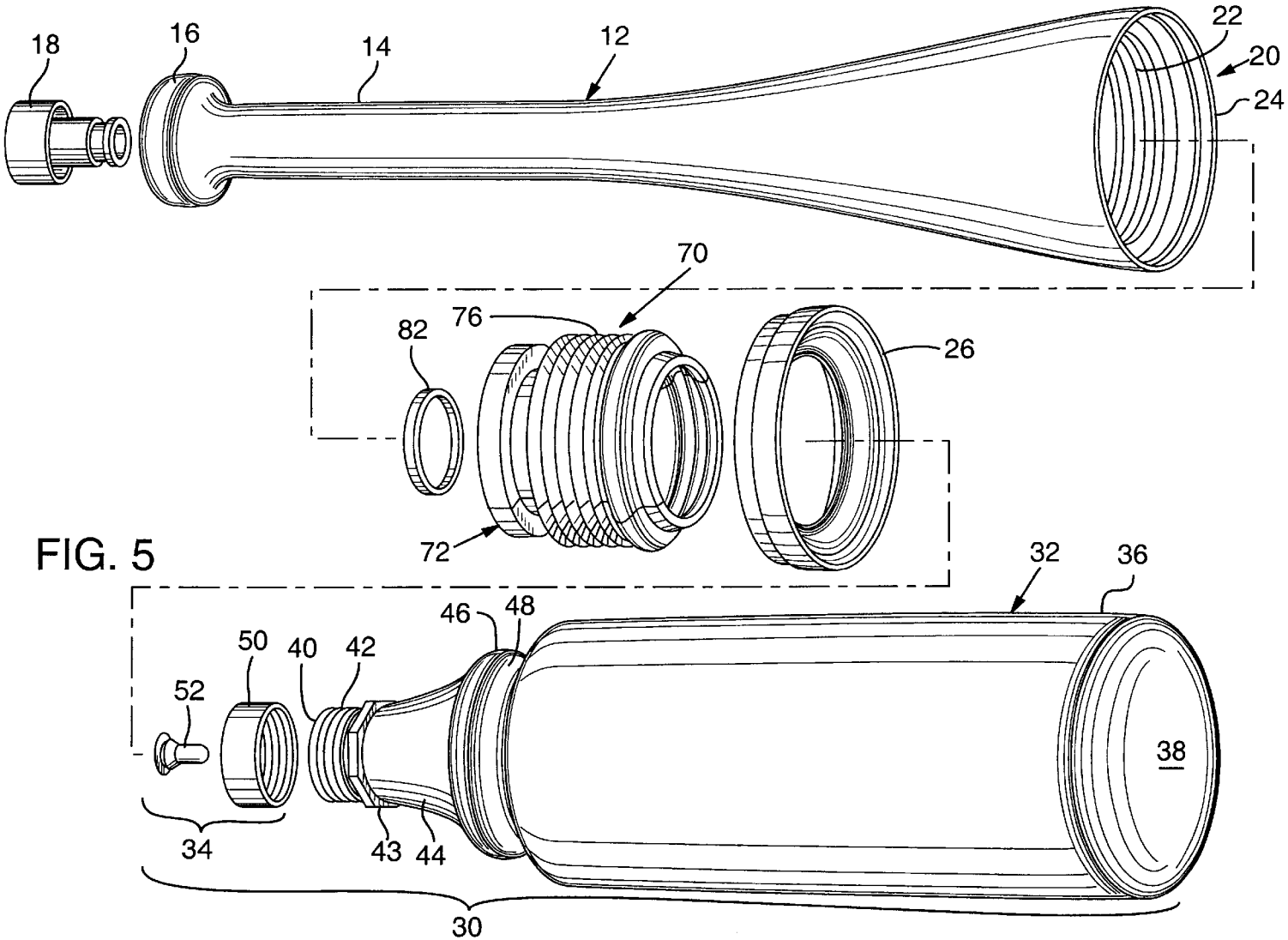
FIG. 5 is an exploded perspective view of the bat of FIG. 1.

Bottle 32 is joined to handle portion 12 through a coupler 70. See FIG. 5. Coupler 70 includes two halves, such as coupler half 72 shown in FIG. 4. The two halves of coupler 70 are fit together over the bottle between the open end and the body portion. The assembled coupler includes a recess 74 to receive shoulder 46 on the bottle and external threads 76 to engage internal thread 22 in handle portion 12 thus joining the bottle to the handle.

The coupler and bottle are screwed into the handle socket until the end of the cylindrical portion adjacent the waist is urged against gasket 26. Thus, it can be seen that the bottle is stabilized by the contact with the gasket and the grip of the coupler on the shoulder. This spreads the forces created during use over a large area of the bottle and away from the threaded end, where the bottle is not as strong. Since much of the impact load on the striking portion is torque, gripping the bottle where the radius is large provides good mechanical advantage to resist the torque. The described embodiment also has the advantage that the closure structure or seal is isolated from the forces between the bottle and handle portion occurring during impact.

Coupler 70 includes a recess 80 shaped to receive polygonal collar 43. The connection between recess 80 and collar

43 prevents the bottle from rotating in the coupler. A gasket 82 fits into recess 80 beneath the collar to cushion and further stabilize the bottle. It should be noted that in the preferred embodiment, the engagement of the collar in the recess prevents rotation, but does not constrain axial displacement of the bottle in the coupler.

The coupler includes a hole 78 which is aligned with locking hole 28 during assembly so that a locking pin 79 can be installed to prevent subsequent disassembly of the handle and striking portions. The locking pin may be glued, spun or sonically pressed into place to prevent it from being removed.

The bat of the present invention is particularly adaptable for use with a ball including a super-ball core with a polyurethane foam cover.

While the invention has been disclosed in its preferred form, the specific embodiment thereof as disclosed and illustrated herein is not to be considered in a limiting sense as numerous variations are possible and no single feature, function or property of the disclosed embodiment is essential. The invention is to be defined only by the scope of the issued claims.

I claim:

1. A bat comprising:

a handle portion including a socket;

a pressurized striking portion; and a coupler adapted to receive one end of the striking portion and be assembled to the handle portion to secure the striking portion to the handle portion, wherein the socket is adapted to receive the coupler.

2. The bat of claim 1, wherein the striking portion is held away from the handle portion by the coupler.

3. The bat of claim 1, wherein the socket includes an internal thread and the coupler includes a matching external thread and the coupler is assembled to the handle portion by screwing the coupler into the socket.

4. The bat of claim 1, wherein the striking portion includes a radial local extremum which is engaged by the coupler.

5. The bat of claim 4, wherein the striking portion includes a bottle with an open end and a closure structure adapted to seal the open end, and the local extremum is located away from the open end.

6. The bat of claim 1, wherein the striking portion includes a polygonal collar which is received by the coupler to prevent the striking portion from rotating relative to the coupler.

7. The bat of claim 1, wherein the socket includes an open end, with an elastomeric gasket being disposed between the open end of the socket and the striking portion.

8. A bat comprising:

a handle portion with a socket at a first end;

a pressurized striking portion, the striking portion including a bottle and a closure structure adapted to seal an opening at a handle end of the bottle, the bottle further including radial local extremum located spaced away from the opening, where the extremum is used to secure the handle end of the bottle in the socket; and a coupler adapted to receive the handle end of the bottle and fit at least partially into the socket to secure the bottle to the handle portion.

9. The bat of claim 8, wherein the socket includes internal threads and the coupler includes external threads adapted to engage the internal threads in the socket.

10. The bat of claim 9, further comprising a locking pin positioned to extend through the internal and external threads to lock the coupler and handle portion against relative rotation.

11. The bat of claim 8, wherein the bottle includes a polygonal collar non-rotatably coupled to the handle portion to prevent relative rotation between the bottle and the handle portion.

12. The bat of claim 8, further comprising an elastomeric gasket interposed at least partially between the bottle and the handle portion.

* * * * *